United States Patent [19]

Lundquist

[11] 4,343,220

[45] Aug. 10, 1982

[54] VIBRATO ATTACHMENT FOR STRINGED INSTRUMENTS

[76] Inventor: Eric G. Lundquist, 2340 - 22nd St., Rockford, Ill. 61108

[21] Appl. No.: 253,789

[22] Filed: Apr. 13, 1981

[51] Int. Cl.[3] ..... G10D 3/00

[52] U.S. Cl. ..... 84/313; 84/274; 84/307

[58] Field of Search ..... 84/274–279, 84/298–299, 307, 313

[56] References Cited

U.S. PATENT DOCUMENTS

| | | | |
|---|---|---|---|
| 714,658 | 12/1902 | Barginde . | |
| 1,900,489 | 3/1933 | Eisenberg | 84/274 X |
| 2,136,627 | 11/1938 | Lohman | 84/313 |
| 3,424,049 | 1/1969 | Daniel | 84/313 |
| 3,910,152 | 10/1975 | Kusakawa | 84/313 X |

FOREIGN PATENT DOCUMENTS

| | | | |
|---|---|---|---|
| 47785 | 7/1889 | Fed. Rep. of Germany | 84/313 |
| 144496 | 1/1936 | Fed. Rep. of Germany | 84/313 |
| 22223 | 10/1963 | German Democratic Rep. | 84/275 |

*Primary Examiner*—Lawrence R. Franklin

*Attorney, Agent, or Firm*—Leydig, Voit, Osann, Mayer & Holt, Ltd.

[57] ABSTRACT

A vibrato attachment for a stringed instrument such as a violin includes a movable member which projects under the bridge of the instrument and is movable back and forth to raise and lower the bridge thereby to vary the tension of the strings of the instrument. A movable actuator is disposed outside the sound box of the instrument at a location where it is readily engaged and moved by a part of the body of the person playing the instrument. Movement of the actuator is transmitted to the member under the bridge by a connector which extends from the actuator through a hole in the sound box, a rod in the sound box and another connector which extends through a second hole in the sound box and which joins the rod and the member.

6 Claims, 5 Drawing Figures

VIBRATO ATTACHMENT FOR STRINGED INSTRUMENTS

BACKGROUND OF THE INVENTION

This invention relates to a vibrato attachment for stringed instruments such as violins and, more particularly, to an attachment of the type which moves the bridge of the instrument thereby to vary the tension of the strings and produce the vibrato effect.

SUMMARY OF THE INVENTION

The general object of the invention is to provide a new and improved vibrato attachment which raises and lowers the bridge and which is easily operated by the player of the instrument when the instrument is in its normal playing position.

A more detailed object is to accomplish the foregoing by using a movable member which is disposed under the bridge and moves the bridge up and down and by employing an actuator which is operated by a part of the body of the player to move the member.

DETAILED DESCRIPTION OF THE PREFERRED EMBODIMENTS

Figure 1:
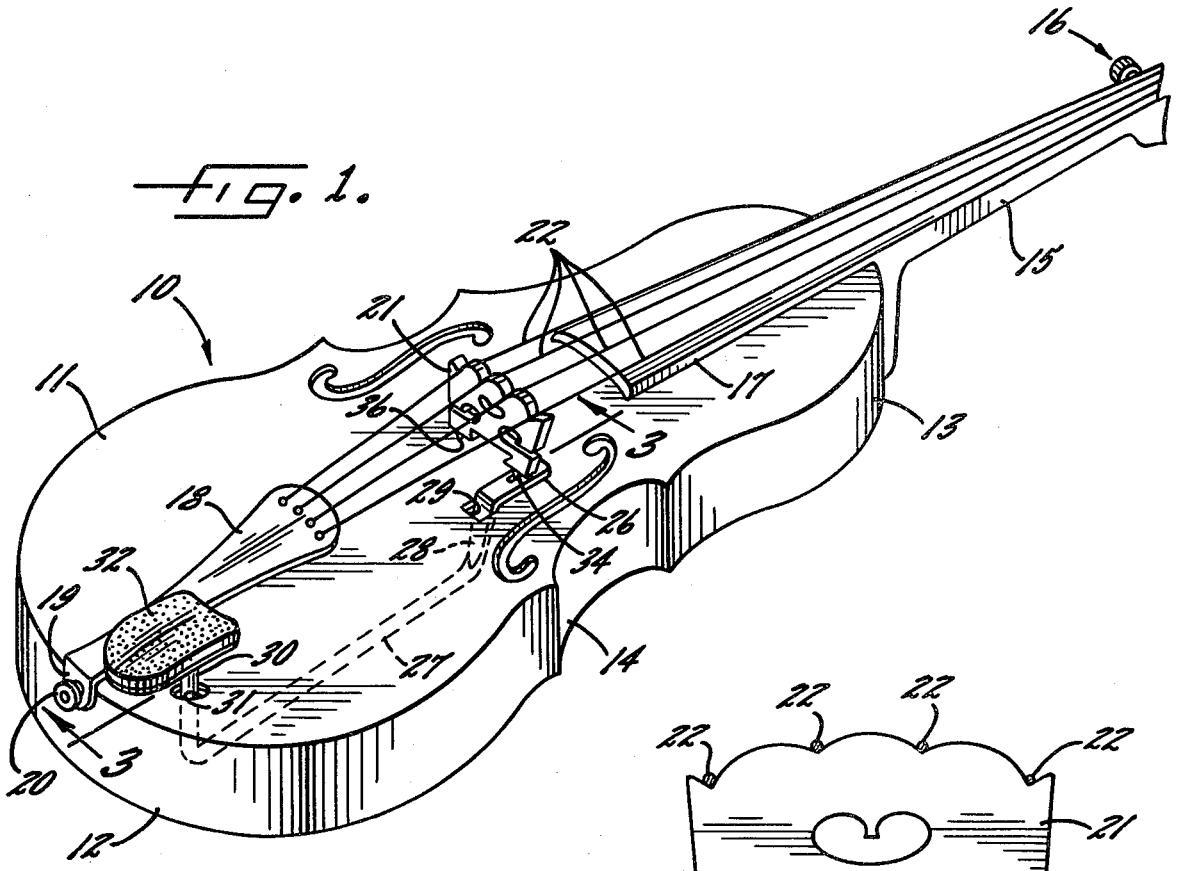
FIG. 1 is a fragmentary perspective view of a violin incorporating a vibrato attachment embodying the invention.

Although the invention may be utilized in connection with various types of stringed instruments, it is shown in the drawings for purposes of illustration as embodied in a violin. As is conventional, the latter includes a hollow sound box 10 composed of a top wall 11 and a bottom wall (not shown) joined by generally arcuate front and rear end walls 12 and 13 which merge with contoured side walls 14. An elongated neck 15 is secured to the rear end wall 13 and projects outwardly therefrom and the usual peg box 16 is mounted on the outer end of the neck. A finger board 17 mounted on top of the neck extends the full length of the neck from the peg box and overlies the end portion of the sound box 10 adjacent the neck. At the other end of the sound box is a tail piece 18 which is on the top wall 11 of the sound box and which has a downturned flange 19 secured to the front end wall 12 by a screw 20. Between the finger board 17 and the tail piece 18 is a bridge 21 formed with four grooves on its upper edge to receive four strings 22 which are anchored at one end to the tail piece and connected at the other end to the peg box 16 for individual tuning. The bridge 21 may include the customary supporting legs 23 and 24 and, by virtue of being tensioned, the strings 22 bear downwardly on the bridge.

The present invention contemplates the provision of a novel mechanism which is operable by a part of the body of a person playing the instrument and which raises and lowers the bridge 21 to vary the tension of the strings 22 thereby to produce a vibrator effect as the instrument is played. In general, this mechanism includes a member 26 disposed between the top wall 11 of the sound box 10 and the underside of the bridge and movable relative to the top wall and the bridge to move the latter up and down. An elongated movable rod 27 is disposed within the soundbox and the rod is joined to the member 26 by a connector 28 which is connected to the rod and which projects up through a hole 29 in the top wall 11 of the box near the bridge 21, the exposed end of the connector being connected to the member 26. At a point spaced from the connector 28, a second connector 30 projects through another hole 31 in the sound box and joins the rod with an actuator 32 disposed outside the box. The hole 31 is located so that the actuator may readily be alternately moved and released by a person playing the instrument. Through the rod 27 and the connectors 28 and 30, movement of the actuator moves the member 26 to raise the bridge from its normal position and the bridge returns to its normal position under the tension of the strings 22 when the actuator is released.

Figure 2:
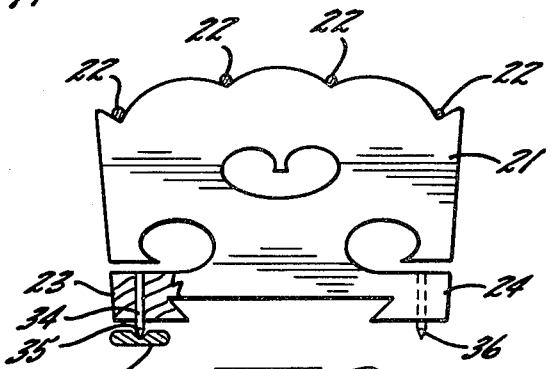
FIG. 2 is a rear elevational view of the bridge with parts broken away and shown in section.
Figure 3:
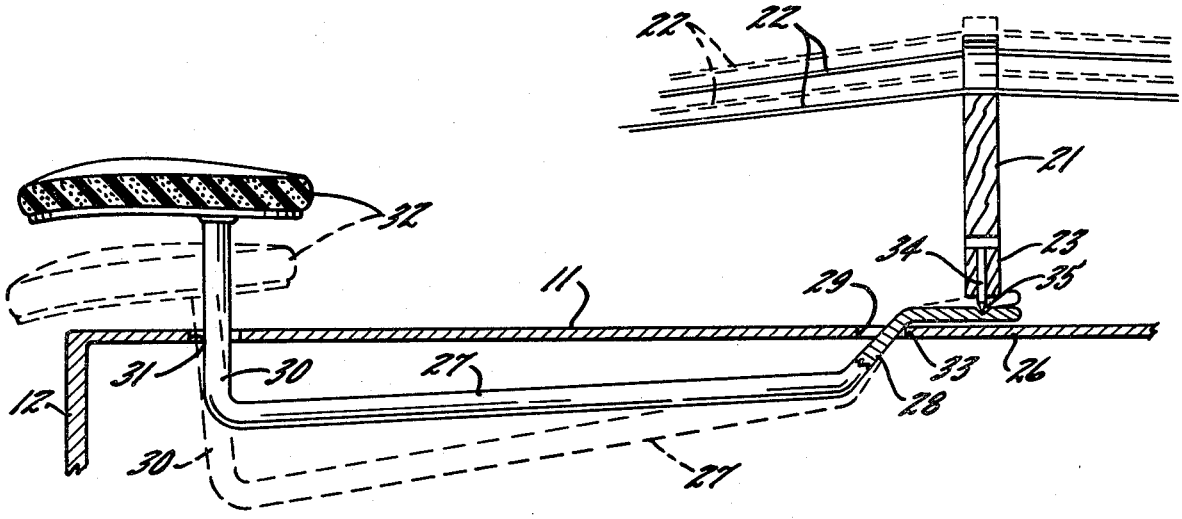
FIG. 3 is an enlarged fragmentary sectional view taken along the line 3—3 in FIG. 1.

In the form shown in FIGS. 1, 2 and 3, the rod 27, the connector 28 and the member 26 are a rigid integral unit which constitutes a lever fulcrumed on the edge of the hole 29 as indicated at 33 with the member 26 forming one arm of the lever and the rod and the connector 28 forming the other arm. A pointed pin 34 projects through the underside of the leg 23 of the bridge 21 and into depression 35 (FIG. 2) in the member 26 and a similar pin 36 projects down from the underside of the leg 24 and is pressed into the top wall 11 of the sound box 10. The two pins permit the bridge to rock up and down about the pin 36 as the lever 26, 27, 28 is rocked between the solid line and broken line positions illustrated in FIG. 3. In this form, the actuator 32 is the conventional chin-rest except that, instead of being stationarily mounted on the sound box, it is mounted on the upper end of the connector 30 which is a vertical extension of the rod 27 and projects through the hole 31 which in this instance is formed in the top wall 11 of the sound box near the end wall 12. Thus, by depressing and releasing the chin-rest, the player may rock the member 26 and hence the bridge 11 and this produces the desired vibrato.

Figure 4:
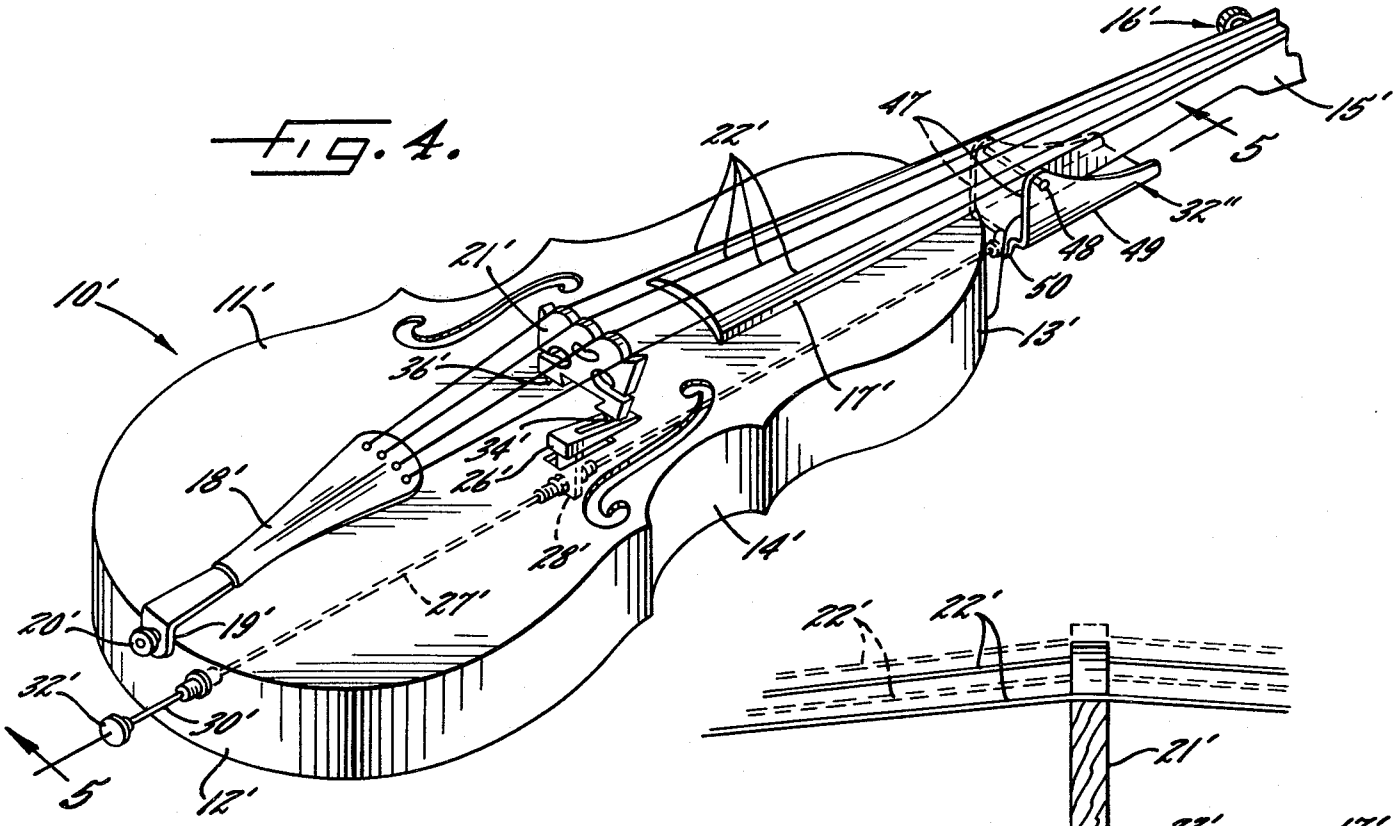
FIG. 4 is a perspective view similar to FIG. 1 but shows a modified form of the vibrato attachment.
Figure 5:
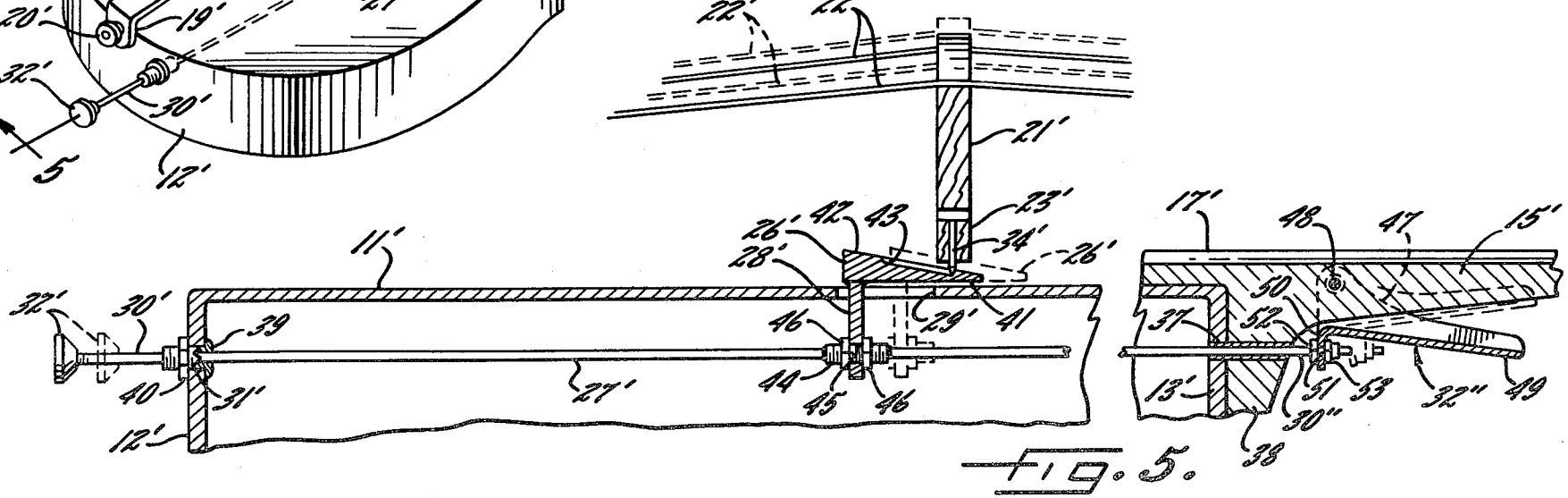
FIG. 5 is an enlarged fragmentary sectional view taken along the line 5—5 in FIG. 4.

In the modified form of the invention illustrated in FIGS. 4 and 5 wherein corresponding parts are indicated by the same but primed reference numerals, the arrangement is such that the member 26' may be moved to raise the bridge 21' by another part of the player's body as, for example, the chest or the hand which holds the neck 15'. To this end, the rod 27' extends longitudinally the full length of the sound box 10' and is mounted in the latter for endwise movement. Thus, one end of the rod slides in a sleeve 37 which is pressed into the rear end wall 13' of the sound box and the abutting portion 38 of the neck 15'. The other end of the rod slides in a bushing 39 which projects through the front wall 12' of the sound box and is held in place by a nut 40 threaded onto the exterior of the bushing.

The member 26' in the modified form is a wedge which projects under the leg 23' of the bridge 21' and slides back and forth with the rod 27' to raise and lower the bridge. The wedge has a flat underside 41 which slides on the top wall 11' of the sound box and an inclined upper surface 42 which projects under the bridge led 23'. A longitudinal groove 43 is formed in the surface 42 and the pin 34' in the leg 23' projects into the groove to permit the wedge 26' to slide. To slide the wedge in response to the endwise reciprocation of the rod 27', the connector 28' is an upright bar rigidly attached to both the wedge and the rod and this bar projects through the hole 29' which, in this instance, is elongated in the lengthwise direction of the sound box to accommodate the corresponding movement of the bar as imparted by the rod. The bar 28' is rigidly attached to the wedge 26' as by any suitable adhesive and is joined to the rod 27' to move back and forth with the latter by a threaded nipple 44. The nipple telescopes the rod and is secured to the rod as by solder. The bar is formed with a hole 45 encircling the center portion of the nipple and nuts 46 threaded on opposite ends of the nipple clamp against opposite sides of the bar so that the rod, the bar and the wedge move together as a rigid unit.

As stated above, the slidable rod 27' may be moved by either the chest or the string hand of the player and the form of the invention illustrated in FIGS. 4 and 5 provides for both types of operations although the invention contemplates that either could be provided alone. Thus, to move the rod by the chest or perhaps by the shoulder of the player, the second connector 30' is an extension of the rod projecting beyond the front wall 12' of the sound box 10' and the actuator 32' is a small pad threaded onto the end of the extension 30'. With this arrangement, the pad 30' normally is against the player's body. As the instrument is being played, the player pulls the instrument toward him and this slides the rod 27' and hence the wedge 26' forward relative to the sound box. As a result, the bridge 21' and the strings 22' are raised as indicated by the broken lines in FIG. 5. As the instrument then is moved away from the body, the tension of the strings produces a camming effect between the pin 34' and the wedge 26' and this moves the wedge and the rod back toward their original positions. Hence, the bridge and the strings also move back toward their original positions. This back and forth movement of the instrument is repeated to produce the vibrato effect.

To slide the rod 27' by the string hand of the player, the actuator 32'' is a lever disposed beneath and fulcrumed on the neck 15' adjacent the front wall 13' of the sound box 10' where it rests in the palm of the player's hand. Herein, the lever 32'' is a U-shaped sheet metal stamping with ears 47 straddling the neck and the fulcrum is formed by a pivot pin 48 which projects through the ears and the neck. One arm 49 of the lever is comparatively long and projects away from the sound box, this arm normally being spaced below the neck as shown in solid lines in FIG. 4 and being the part engaged by the palm. The other arm 50 of the lever extends generally downwardly and is joined to the connector 30'' which, in this instance, is an extension of the rod 27' projecting rearwardly beyond the rear wall 13' of the sound box. The end portion 30'' is threaded and projects through a hole 51 in the arm 50 and nuts 52 and 53 are threaded onto the extension on opposite sides of the arm with the latter being somewhat loose between the nuts to permit the lever 32'' to rock about the pin 48. With this arrangement, the lever arm 49 may be turned up against the neck as shown in broken lines and this pulls the rod 27 forward. In the same manner as described above, the wedge 26' slides forward and lifts the bridge 21' and the strings 22'. Also, as the lever arm 49 is released, the same camming action between the pin 34' and wedge 26' occurs and this moves the rod 27' and the lever 32'' and hence the bridge 21' and the strings 22' back toward their original positions. Thus, a vibrato is produced by repeatedly moving the lever arm 49 up and then releasing it.

I claim:

1. In a stringed musical instrument, the combination of, a hollow sound box having top and bottom walls joined by end walls and side walls, an elongated neck projecting outwardly from one end of said sound box, a peg box mounted on the outer end of said neck, a tail piece mounted on the top of said sound box adjacent the other end of said box, a bridge disposed on top of said box between said neck and said tail piece, a plurality of spaced strings extending from said tail piece over said bridge to said peg box and tensioned by the peg box to bear downwardly on the bridge, a member disposed between the top of said box and said bridge and movable relative to the box to raise and lower the bridge thereby to increase and decrease the tension of said strings and cause a vibrato as the instrument is played, a first hole formed in the top of said box adjacent said member, a second hole formed in said box and at a point spaced from said first hole to be adjacent a part of the body of a player of the instrument, an actuator disposed outside said box and adjacent said second hole to be engaged and moved by the body of the player, an elongated movable rod disposed within said box and extending from said first hole to said second hole, a first connector projecting through said first hole and rigidly joining said rod and said member, said connector being operable to move said member as said rod is moved thereby to move said bridge up and down, and a second connector projecting through said second hole to join said actuator and said rod and operable to move said rod upon movement of said actuator.

2. The combination as defined in claim 1 in which said member is an arm of a lever fulcrumed on the edge of said first hole and said lever is formed by said arm, said first connector and said rod to rock against the tension of said strings, the tension of the strings normally holding said arm against the top of said sound box and said rod in a normal upper position, said second hole being in said top of said sound box with said second connector projecting up through said second hole, and said actuator being a chin-rest mounted on said second connector whereby depressing the chin-rest rocks said rod down from said normal position thereby rocking said arm up and lifting said bridge.

3. The combination as defined in claim 1 in which said rod extends longitudinally of said sound box and is mounted in said box for endwise reciprocation, said member being a wedge slidable on the top of said box and having an inclined surface engaging the underside of the bridge whereby the bridge is raised and lowered as the wedge slides back and forth, said first connector being operable to slide said wedge back and forth in unison with the reciprocation of said rod, said second hole being formed in an end wall of said box, and said second connector being an extension of said rod.

4. The combination as defined in claim 3 in which said second hole is in the end wall of said sound box adjacent said tail piece and said actuator is a pad mounted on the end of said second connector.

5. The combination as defined in claim 3 in which said second hole is in the end wall of said sound box adjacent said neck, said actuator being a lever fulcrumed on said neck and having first and second arms, said first arm being disposed below and spaced from said neck to be engaged by the palm of the player's hand the fingers of which engage said strings whereby the player may use that hand to rock said lever, and said second arm being connected to said second connector to reciprocate said rod in response to the rocking of said lever.

6. The combination as defined in claim 5 including a third hole formed in the end wall of said sound box adjacent said tail piece, a third connector formed as an extension of said rod and projects through said third hole, and a pad mounted on the end of said third connector, said rod being reciprocated as said pad is pushed and released by the player of the instrument.

* * * * *